US007995424B2

(12) United States Patent
Irie et al.

(10) Patent No.: US 7,995,424 B2
(45) **Date of Patent: *Aug. 9, 2011**

(54) ELECTRONIC DEVICE AND ELECTROMAGNETIC WAVE TIMEPIECE

(75) Inventors: Michio Irie, Suwa (JP); Osamu Urano, Okaya (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/784,835

(22) Filed: May 21, 2010

(65) Prior Publication Data

US 2010/0226214 A1 Sep. 9, 2010

Related U.S. Application Data

(62) Division of application No. 12/103,323, filed on Apr. 15, 2008, now Pat. No. 7,751,283.

(30) Foreign Application Priority Data

Apr. 16, 2007 (JP) ..... 2007-106762
Feb. 4, 2008 (JP) ..... 2008-023564

(51) Int. Cl.
*G04C 11/02* (2006.01)

(52) U.S. Cl. ..... 368/47; 368/46

(58) Field of Classification Search ..... 368/47
See application file for complete search history.

(56) References Cited

U.S. PATENT DOCUMENTS

2005/0111304 A1 5/2005 Pikula et al.

FOREIGN PATENT DOCUMENTS

JP 2000-321383 11/2000
JP 2001-166071 6/2001

*Primary Examiner* — Renee Luebke
*Assistant Examiner* — Jason Collins
(74) *Attorney, Agent, or Firm* — Harness, Dickey & Pierce, P.L.C.

(57) ABSTRACT

An electronic device includes a timer which measures a current time, a display which displays information based on the time, a receiver which, by receiving and decoding a signal, including time information indicating a standard time, which is encoded by means of a predetermined communication system, acquires the time information, and a controller which, as well as instructing the receiver to acquire the time information, corrects a deviation of the measured time, based on the time information, and instructs the display to display information based on the corrected time. The controller gives an instruction in such a way that no time period occurs in which both the receiver's operation of acquiring the time information, and the display's operation of displaying the information based on the corrected time, are executed.

14 Claims, 8 Drawing Sheets

ELECTRONIC DEVICE AND ELECTROMAGNETIC WAVE TIMEPIECE

CROSS REFERENCE TO RELATED APPLICATIONS

This application is a divisional of U.S. patent application Ser. No. 12/103,323 filed on Apr. 15, 2008. This application claims the benefit of Japanese Patent Application No. 2008-023564, filed Feb. 4, 2008 and 2007-106762, filed Apr. 16, 2007. The disclosures of the above applications are expressly incorporated by reference herein.

BACKGROUND

1. Technical Field

The present invention relates to an electronic device and an electromagnetic wave timepiece which receive a communication electromagnetic wave including time information.

2. Related Art

In an electromagnetic wave timepiece which receives time signal transmitted by means of an electromagnetic wave, and displays accurate time information, in addition to a method which receives a standard frequency and time signal, in a low frequency band, transmitted from a ground base station, or a time signal, in an ultrahigh frequency band, transmitted from a GPS (Global Positioning System) satellite, recently, as described in JP-A-2000-321383, an electromagnetic wave timepiece has been proposed which receives a time signal, included in an electromagnetic wave in an ultrahigh frequency band, which is CDMA (Code Division Multiple Access) modulated and transmitted for the purpose of mobile communication, corrects a self-measured time, and displays an accurate time. It has been known that this kind of electromagnetic wave in the ultrahigh frequency band, as it is relayed far and wide by various kinds of repeater, can be received in a good condition even at various movement destinations, such as an inside of a building or underground, in comparison with the standard frequency and time signal in the low frequency band, and the electromagnetic wave from the GPS satellite. Also, JP-A-2001-166071 has proposed an electromagnetic wave timepiece which generates electric power by converting kinetic energy generated by means of a rotation of a rotating spindle into electric energy, and accumulates and uses the generated electric power, and which stops a reception operation during the electric power generation in order to avoid a decrease in an electromagnetic wave reception sensitivity due to a noise occurring when generating the electric power.

The heretofore described kinds of electromagnetic wave timepiece often being used worn on an arm in a mode of a wrist watch, in order to realize a reduction in a size and a weight, a small battery is incorporated as a power supply. However, there has been the following problem. That is, because there are large amounts of consumption current in an operation of receiving the electromagnetic wave and acquiring the time information, and in an operation of driving a drive unit in order to update a display time, in the event that these two operations are executed overlapping temporarily, as the consumption current increases abruptly, a capacity of the battery decreasing remarkably, it is impossible to efficiently consume electric power which can be supplied from the battery. Furthermore, recently, there has been the following problem. That is, as the electromagnetic wave timepiece often receives and corrects the electromagnetic wave in order to reduce an error in the display time as much as possible, for example, in the event that the electromagnetic wave is received while the drive unit of the electromagnetic wave timepiece is in the process of driving a second hand, a noise arises from a drive electric circuit or the like, and the electromagnetic wave reception sensitivity decreases due to this noise.

SUMMARY

An electronic device of an aspect of the invention includes: a timer which measures a current time; a display which displays information based on the time; a receiver which, by receiving and decoding a signal, including time information indicating a standard time, which is encoded by means of a predetermined communication system, acquires the time information; and a controller which, as well as instructing the receiver to acquire the time information, corrects a deviation of the measured time, based on the time information, and instructs the display to display information based on the corrected time. The controller gives an instruction in such a way that no time period occurs in which both the receiver's operation of acquiring the time information, and the display's operation of displaying the information based on the corrected time, are executed.

According to the aspect of the invention, as the controller gives the instruction in such a way that the receiver's operation of acquiring the time information and the display's operation of displaying the information based on the corrected time are not concurrently executed, in the event that one of the time display and the time information acquisition is executed, no instruction is given to execute the other. Consequently, regarding a current consumed by the electronic device, as a current consumed when the time is displayed, and a current consumed when the time information is acquired, are not consumed added together, it is possible to suppress a maximum current to be consumed. Consequently, the electronic device can efficiently consume the electric power supplied from the power supply. In addition, as no radio signal is received when the corrected time is displayed, it is possible to avoid an electromagnetic wave reception sensitivity decreasing due to a noise occurring when displaying the time.

In the electronic device of the aspect of the invention, it is preferable that the controller includes a reception instruction unit which instructs the receiver to acquire the time information, an extraction unit which extracts the standard time from the acquired time information, a correction unit which corrects a time deviation calculated based on the standard time, and a display control unit which instructs the display to display the information based on the corrected time, and that the reception instruction unit, in a case in which the information based on the corrected time is displayed on the display, does not give the instruction to acquire the time information.

According to the aspect of the invention, the display of the corrected time is executed in priority to the acquisition of the time information.

In the electronic device of the aspect of the invention, it is preferable that it further includes a detector which detects an update of the information based on the time displayed on the display, and that the reception instruction unit, based on the detection of the detector, gives the instruction to acquire the time information.

According to the aspect of the invention, it is possible to reliably detect that the display time is updated.

In the electronic device of the aspect of the invention, it is preferable that the update of the information includes an update made by means of a rounding up of the time.

According to the aspect of the invention, it is possible to detect that the information is updated by means of the rounding up of the time.

In the electronic device of the aspect of the invention, it is also acceptable that the detector further detects a finish of the update, and the reception instruction unit, in the event that the detector detects the finish of the update, gives the instruction to acquire the time information. Also, in the electronic device of the aspect of the invention, it is preferable that the detector still further detects a predetermined display time, and that the reception instruction unit, in the event that the detector detects the predetermined display time, does not give the instruction to acquire the time information.

According to the aspect of the invention, as a process of detecting the predetermined display time is easy in comparison with a case of detecting the update of the time, it is possible to reduce electric power consumed at a time of the detection.

In the electronic device of the aspect of the invention, it is also acceptable that it still further includes a power supply which supplies electric power, and a remaining amount detection unit which detects a remaining amount of the electric power which can be supplied from the power supply, and that the reception instruction unit, in accordance with the detected remaining amount of the electric power, detects one of the update of the display time and the predetermined display time.

In the electronic device of the aspect of the invention, it is also acceptable that the display's operation of displaying the information based on the corrected time is intermittently driven for a predetermined unit time period, and a time period required for the receiver's operation of acquiring the time information is shorter than the predetermined unit time period. Also, in the electronic device of the aspect of the invention, it is also acceptable that the receiver's operation of acquiring the time information is executed for the time period for which the display's operation of displaying the information based on the corrected time is intermittently driven.

In the electronic device of the aspect of the invention, it is also acceptable that the predetermined communication system is a code division multiple access system. Also, in the electronic device of the aspect of the invention, it is also acceptable that the electronic device is driven by means of a small battery.

Then, by applying the heretofore described electronic device to an electromagnetic wave timepiece such as a wrist watch, it is possible to provide an electromagnetic wave timepiece which efficiently consumes the electric power and, when receiving the electromagnetic wave, is not affected by the noise occurring during the drive.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, a description will be given, with reference to the drawings, of embodiments of an electromagnetic wave timepiece, as a mode of an electronic device according to some aspects of the invention.

Embodiment 1

Figure 1:
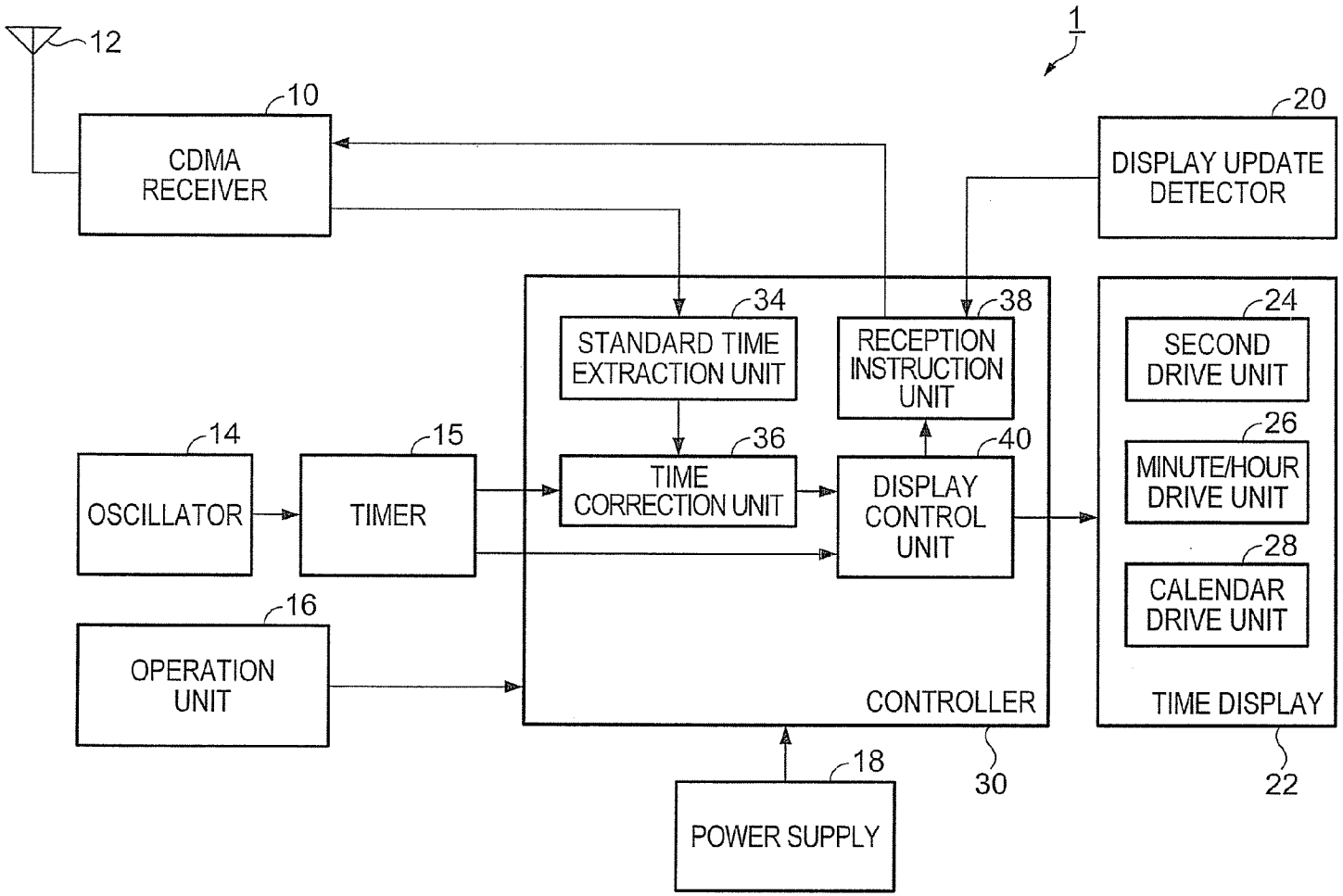
FIG. 1 is a block diagram showing a functional configuration of an electromagnetic wave timepiece according to Embodiment 1 of the invention.

FIG. 1 is a block diagram showing a functional configuration of an electromagnetic wave timepiece 1 according to Embodiment 1 of the invention. The electromagnetic wave timepiece 1, being a mode of a so-called analog quartz wrist watch, is provided with a function of calculating a time based on a frequency of a crystal oscillator, and displaying a current time with hands and, in addition, a function of receiving an electromagnetic wave including accurate time information, and correcting the displayed time. The electromagnetic wave timepiece 1 includes a CDMA receiver 10, an oscillator 14, a timer 15, an operation unit 16, a power supply 18, a display update detector 20, a time display 22 and a controller 30.

The CDMA receiver 10 receives a communication electromagnetic wave in an ultrahigh frequency band, including time information synchronized with the universal time coordinated (UTC), which is CDMA (Code Division Multiple Access) modulated for the purpose of mobile communication and transmitted from a base station, by means of an antenna 12 in accordance with an instruction from the controller 30, retrieves the time information from the received electromagnetic wave, and transmits it to the controller 30. In Embodiment 1, the CDMA receiver 10, as well as converting a high frequency signal of the received electromagnetic wave into a baseband signal, AD converts it into digital signals, demodulates a sync channel signal with respect to two orthogonal phase digital signals (an I signal and a Q signal) and, by decoding the demodulated sync channel signal, acquires data of the sync channel signal including time data. As the data of the sync channel signal, having a predetermined data length, are stored in a predetermined area, it is possible to easily extract the time data by tracing to a head of the data. The extracted time data are sent to the controller 30.

The oscillator 14 generates a pulse signal serving as a reference. In Embodiment 1, the oscillator 14, including a 32 kHz crystal oscillator, an oscillation circuit, a frequency division circuit and the like, which are not shown, generates the pulse signal every second, and sends the generated pulse signal to the timer 15.

The timer 15 calculates the pulse signal sent from the oscillator 14, and measures the current time. The measured time is sent to the controller 30.

The operation unit 16 being operated by a user of the electromagnetic wave timepiece 1, it is possible for the user to operate a desired function. Information operated with the operation unit 16 is sent to the controller 30. In Embodiment 1, this kind of operation unit 16 is assumed to be an operation button (not shown) provided on an exterior casing or the like of the electromagnetic wave timepiece 1.

The power supply 18 supplies electric power to the electromagnetic wave timepiece 1. In Embodiment 1, although not shown, it is configured of a solar battery, which converts light energy irradiated from an exterior into electric power, and a secondary battery, such as a lithium ion battery, which is rechargeable.

Figure 2:
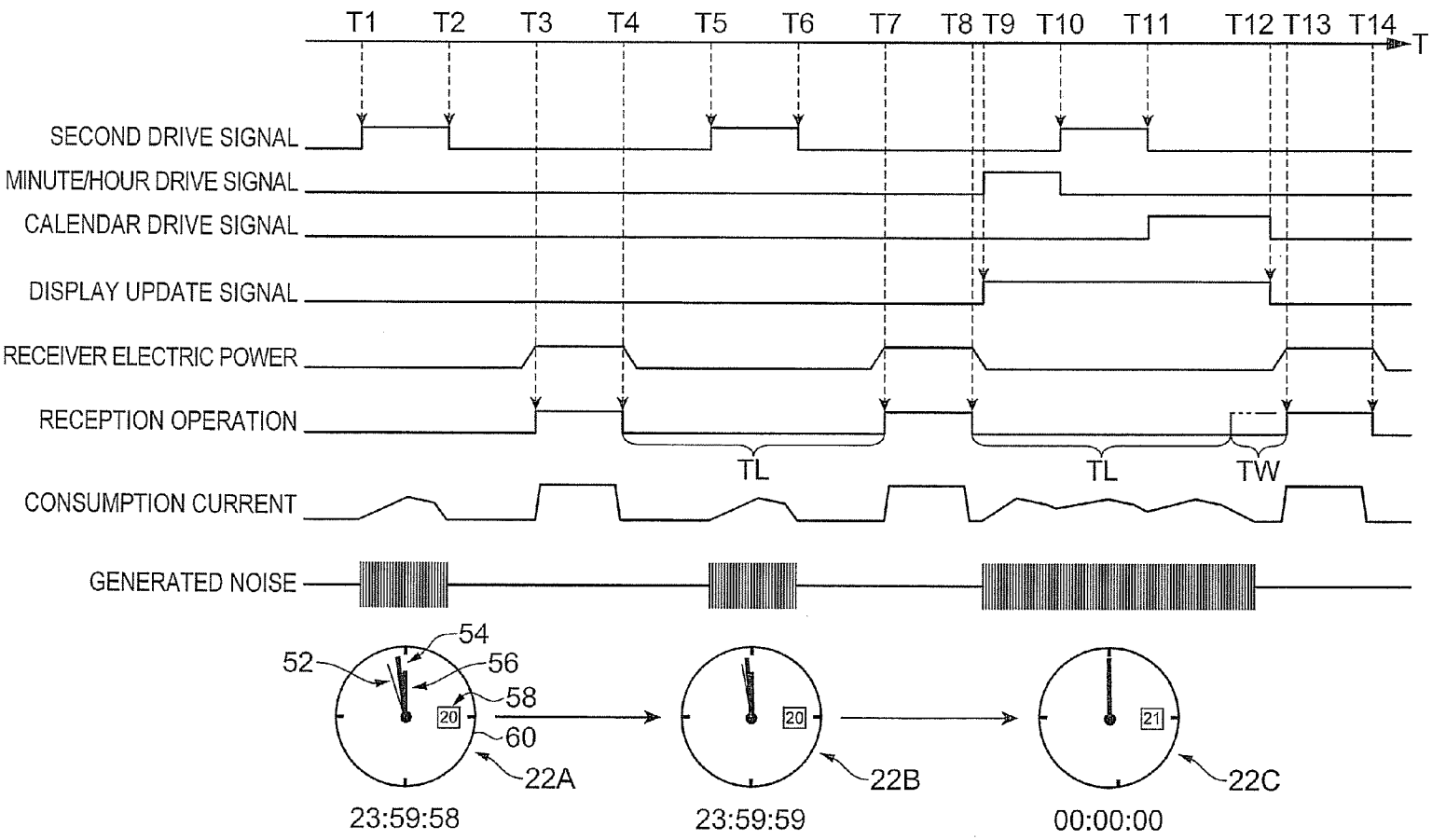
FIG. 2 is a diagram showing a process when a display of the electromagnetic wave timepiece according to Embodiment 1 of the invention makes a transition.

The time display 22, including a second drive unit 24, a minute/hour drive unit 26 and a calendar drive unit 28, displays a time in accordance with the time data sent from the controller 30. In Embodiment 1, the second drive unit 24, minute/hour drive unit 26 and calendar drive unit 28, being assumed to be step motors (not shown) which are driven by means of pulses, are assigned to a second display, a minute/hour display and a calendar display, respectively. Also, the second drive unit 24, minute/hour drive unit 26 and calendar drive unit 28 drive a second hand 52, a minute hand 54 and hour hand 56, and a calendar 58, which are shown in FIG. 2, respectively. It is known that a step motor, as a noise occurs during its drive, causes a decrease in a reception sensitivity in a case in which a receiving apparatus such as the CDMA receiver 10 is carrying out a reception. Also, the second drive unit 24, minute/hour drive unit 26 and calendar drive unit 28 not being limited to the step motors, it is also acceptable that they are ultrasonic motors. Furthermore, the display in the time display 22 not having to provide all of a second, a minute, an hour and a calendar, it is also acceptable to configure in such a way as not to provide, for example, the second hand 52.

The display update detector 20, as well as detecting that the minute/hour display and the calendar display are updated, detects that the displayed minute, hour and date are rounded up by means of this update. In Embodiment 1, two photosensors (not shown) are employed, and they are each embedded in a dial plate 60 (FIG. 2). One of the two photosensors detects that the second hand 52 comes to a position of 12:00:00, while the other photosensor detects that the hour hand 56 and the minute hand 54 come to the position of 12:00:00. Consequently, the display update detector 20, by the fact that the second hand 52 comes to the position indicating 12:00:00, detects a rounding up of a display position of the minute hand 54 and, by the fact that the minute hand 54 comes to the position indicating 12:00:00, detects a rounding up of a display position of the hour hand 56. Furthermore, the display update detector 20, by the fact that the hour hand 56 comes to the position indicating 12:00:00 (00:00:00 a.m.), detects the rounding up of the data of the calendar 58. The display update detector 20 not being limited to the employment of the photosensors, it is also acceptable to employ rotary encoders which detect rotations of the corresponding step motors. Also, it is also acceptable to calculate a display position by summing pulses supplied to a step motor having a given position in which it starts to rotate, and detect a position in which a display is to be updated. A signal indicating the update of the display time, detected by the display update detector 20, is sent to the controller 30.

The controller 30 including a standard time extraction unit 34, a time correction unit 36, a reception instruction unit 38 and a display control unit 40, as well as causing the current time to be displayed on the time display 22, when needed, instructs the CDMA receiver 10 to receive the communication electromagnetic wave including the time information. It is also acceptable that each function unit configuring the controller 30 realizes its function by hardware resources having a CPU, an RAM and the like, which are not shown, cooperating organically with software.

The display control unit 40, after generating a drive signal, which is drivable in each drive unit (24, 26 and 28) of the time display 22, based on a time sent from the timer 15, sends it to each drive unit (24, 26 and 28) of the time display 22. As a result of this, the time calculated by the timer 15 is displayed on the time display 22. In Embodiment 1, as a time is calculated based on the pulse signal generated every second, the second hand 52 is intermittently driven by the second. When the drive signal driving the second hand 52 is sent to the second drive unit 24, the display control unit 40 sends information indicating the drive of the second hand 52 to the reception instruction unit 38. In Embodiment 1, the second hand 52 drive signal output time period is about 5 milliseconds.

The standard time extraction unit 34 acquires a standard time synchronized with the universal time coordinated from the time data sent from the CDMA receiver 10.

The time correction unit 36 generates correction data for correcting a deviation of the time calculated by the timer 15, based on the standard time acquired by the standard time extraction unit 34. The generated correction data are sent to the display control unit 40 and, after being converted into a drive signal for correcting the display time in the time display 22, sent to the time display 22 in accordance with an instruction to intermittently drive the second hand 52.

The reception instruction unit 38 instructs the CDMA receiver 10 to acquire the time data in order to correct the display time. In Embodiment 1, a configuration is such that the time data acquisition instruction, as well as being sent every second, is sent from the user via the operation unit 16 when needed. Also, the reception instruction unit 38 gives the instruction in such a way that the correction of the display time, and the operation of receiving the communication electromagnetic wave and extracting the time data, are not executed overlapping temporally. That is, in a case in which the display control unit 40 sends the drive signal to the second hand 52, or in a case in which the display update detector 20 is transmitting the signal indicating the update of the display time, the reception instruction unit 38 reserves the instruction to acquire the time data for the CDMA receiver 10. In this case, the reception instruction unit 38 waits for a finish of the drive of the second hand 52 by means of the drive signal, as well as a cancellation of the signal indicating the update of the display time, to instruct the CDMA receiver 10 to acquire the time data.

In Embodiment 1, a time period required to acquire the time data by means of the reception operation of the CDMA receiver 10 is about 300 milliseconds. Consequently, in the event that the time data are acquired every second, it is possible to halt the reception operation of the CDMA receiver 10 for about 700 milliseconds, of one second for which the second hand 52 is intermittently driven. Also, in the event that the time data cannot be acquired normally in an initial reception operation, it is possible to attempt the acquisition of the time data by carrying out the reception operation again by the time the second hand 52 is intermittently driven next.

As a heretofore known electromagnetic wave timepiece, which receives a standard frequency and time signal in a low frequency band, requires time to receive the standard frequency and time signal, a display time update is also halted over about 2 to 3 minutes when correcting a time. However, in the electromagnetic wave timepiece 1, as a time period required to receive the standard frequency and time signal and acquire the time data is about 300 milliseconds, it is possible to acquire and correct the time data while the second hand 52 is being intermittently driven, without halting the intermittent drive of the second hand 52.

Next, a description will be given, based on FIG. 2, of details of the time display in the electromagnetic wave timepiece 1 of the heretofore described configuration. FIG. 2 shows a flow of a process when the display of the electromagnetic wave timepiece 1 makes a transition from "11:59:57 p.m." to "00:00:00 a.m.". In order to facilitate an understanding of a procedure of updating the time display, a time T of the axis of abscissa is shown with a time interval extended or contracted as appropriate. Firstly, the drive signal is sent from the display control unit 40 to the second drive unit 24 over 5 milliseconds ranging from a time T1 to a time T2. The step motor of the second drive unit 24 consumes a current and rotates in accordance with this drive signal. As a result of this, the second hand 52 pivots an amount equivalent to one second (through six degrees) clockwise from a current position. As a result of this, a time display 22A displays "11:59:58 p.m.".

Continuing, at a time T3, the controller 30 gives an instruction to correct the display time. The reception instruction unit 38, on receiving this instruction, after confirming that the second hand 52 is in the halted condition, and the display update signal has not been transmitted from the display update detector 20, as well as starting the supply of the electric power to the CDMA receiver 10, instructs the CDMA receiver 10 to acquire the time data. The CDMA receiver 10, on receiving this instruction, receives the electromagnetic wave including the time information, and extracts the time data, over 300 milliseconds ranging from the time T3 to a time T4. Herein, the extracted time data are compared with a time of the electromagnetic wave timepiece 1 in the time correction unit 36, and correction data are generated. Continuing, the display control unit 40, when driving the second hand 52 at a time T5 at which one second has elapsed from the time T1, and displaying "11:59:59 p.m.", corrects the drive signal, based on the correction data, and sends it to the second drive unit 24. The second drive unit 24 which has received this drive signal causes the second hand 52 to pivot an amount equivalent to one second by a time T6. As a result of this, a time display 22B displays "11:59:59 p.m." at the time T6. In Embodiment 1, it is also acceptable to improve a reliability of the time data by extracting the time data in the CDMA receiver 10 continuously up to three times in one second from the second hand 52 being halted until it is driven next.

Continuing, at a time T7 at which a certain time period TL has elapsed from the time T4, in the same way as the case of T3, the controller 30 gives the instruction to correct the display time. The reception instruction unit 38, on receiving this instruction, instructs the CDMA receiver 10 to acquire the time data, and the CDMA receiver 10 receives the electromagnetic wave including the time information, and extracts the time data, over a time period from the time T7 to a time T8. The extracted time data are compared with a time of the electromagnetic wave timepiece 1 in the time correction unit 36, and correction data are generated. Herein, based on the generated correction data, the display control unit 40, before driving the second hand 52 at a time T10 at which one second has elapsed from the time T5, gives an instruction to carry out a minute/hour rounding up operation, which occurs due to the drive of the second hand 52, at the time T9 before the time T10. That is, in response to the fact that the second hand 52 indicates 00" rather than 59", the display control unit 40 sends to the minute/hour drive unit 26 a drive signal for the minute hand 54 to pivot through a predetermined angle (six degrees), as well as for the hour hand 56 to pivot through a predetermined angle (0.5 degrees). The minute/hour drive unit 26 which has received this drive signal drives the hour hand 56 and the minute hand 54 by the time T10.

Next, at the time T10, the display control unit 40, based on the heretofore described correction data, sends the drive signal to the second drive unit 24. The second drive unit 24 which has received this drive signal causes the second hand 52 to pivot an amount equivalent to one second by a time T11. Furthermore, in response to the fact that the hour hand 56 has moved beyond 24:00:00 (00:00:00 a.m.), the display control unit 40 sends the drive signal to the calendar drive unit 28 in order to cause the date of the calendar 58 to advance one day from "20th" to "21st". The calendar drive unit 28 which has received this drive signal drives a calendar plate (not shown) by a time T12. As a result of this, a time display 22C displays "00:00:00 a.m. on the 21st" at the time T12. An order of driving each drive unit (24, 26 and 28) is not restricted.

Herein, after the certain time period TL has elapsed from the time T8, the reception instruction unit 38, in accordance with a program installed in advance, determines an existence or otherwise of the display update signal from the display update detector 20 in order to instruct the CDMA receiver 10 to acquire the time data. In this case, as the display control unit 40 has carried out the minute/hour rounding up operation, and is thus placed in a condition in which the display update signal has been transmitted, the reception instruction unit 38 reserves the time data acquisition instruction for the CDMA receiver 10. Herein, it is also acceptable that the reception instruction unit 38 samples the display update signal in a predetermined period, and that, after confirming a condition in which the display update signal is not transmitted after a time period TW has elapsed, that is, a display update completion, as well as confirming that the second hand 52 is in a non-drive condition, it starts the supply of the electric power to the CDMA receiver 10, and instructs the CDMA receiver 10 to acquire the time data. By repeating the heretofore described kind of process, the electromagnetic wave timepiece 1 continuously displays an accurate time based on the standard time included in an electromagnetic wave signal.

Next, a description will be given, based on FIG. 3, of a flow of a process in a case in which the display time of the electromagnetic wave timepiece 1 is corrected. In the case in which the display time of the electromagnetic wave timepiece 1 is corrected, firstly, an instruction is given to correct a time (step S100). It is also acceptable that this time correction instruction is given from the controller 30 at regular time intervals, as heretofore described, or that it is given from the user of the electromagnetic wave timepiece 1 when needed. Herein, a description will be given, in accordance with FIG. 4, of a flow of a process in the case in which the time correction instruction is given from the user of the electromagnetic wave timepiece 1.

Firstly, the electromagnetic wave timepiece 1 calculates the current time, based on the pulse signal generated by the oscillator 14 (step S150), and displays the calculated current time on the time display 22 (step S152). Continuing, the electromagnetic wave timepiece 1, at predetermined intervals, investigates and determines whether or not it has been requested by the user to confirm an electromagnetic wave reception condition (step S154).

Herein, if the confirmation of the reception condition has not been requested (No in step S154), the electromagnetic wave timepiece 1 returns to an initial process (step S150). On the other hand, if the confirmation of the reception condition has been requested (Yes in step S154), the electromagnetic wave timepiece 1, as well as inquiring into the electromagnetic wave reception condition of the CDMA receiver 10, receives a response on the reception condition from the CDMA receiver (step S156), and displays the reception condition to the user by means of an unshown LED or the like (step S158).

Continuing, the electromagnetic wave timepiece 1 determines whether or not a time correction has been requested by the user who has confirmed the reception condition (step S160). Herein, if no time correction has been requested by the user (No in step S160), the electromagnetic wave timepiece 1 returns to the initial process (step S150). On the other hand, if a time correction has been requested by the user (Yes in step S160), the electromagnetic wave timepiece 1 moves to a next process (step S102) of FIG. 3.

Figure 5:
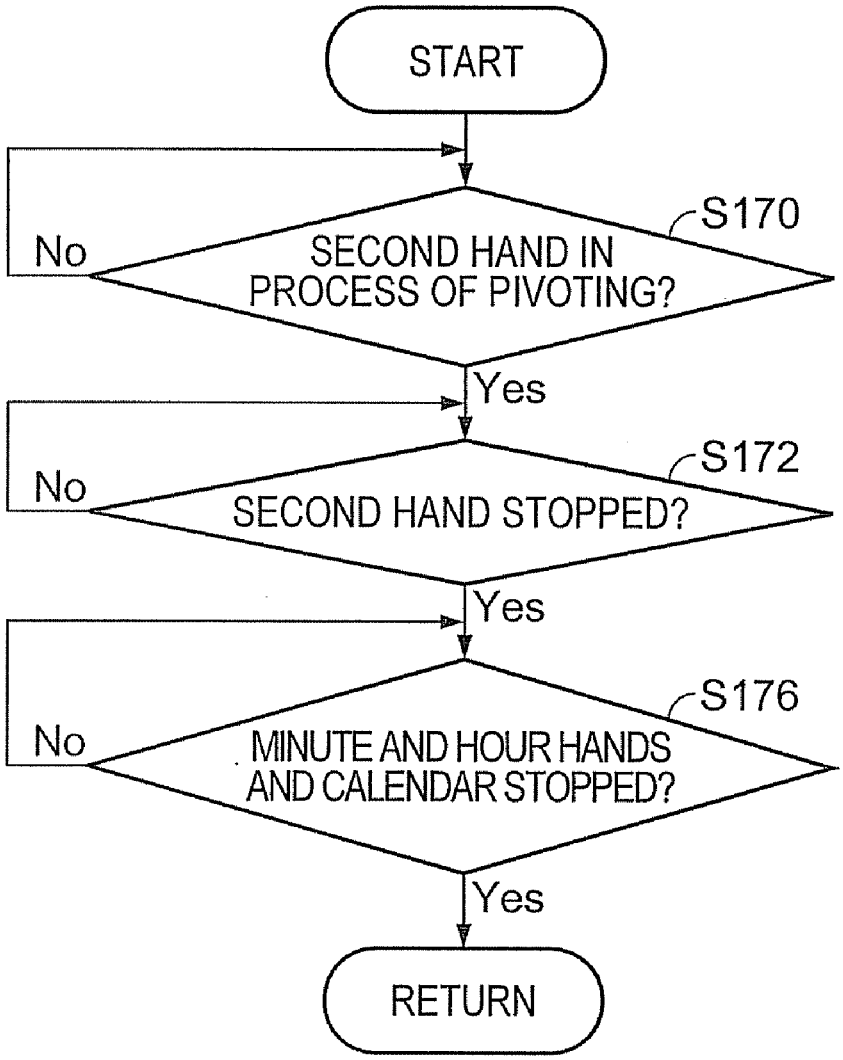
FIG. 5 is a flowchart showing a flow of a process which investigates a condition of the display time of the electromagnetic wave timepiece according to Embodiment 1 of the invention.

In step S102, the electromagnetic wave timepiece 1 investigates a condition of the time display. Herein, a description will be given, based on FIG. 5, of a flow of a process which investigates the condition of the time display in Embodiment 1. Firstly, the electromagnetic wave timepiece 1 determines whether or not the second hand 52 is in the process of pivoting (step S170) and, if the second hand 52 is not in the process of pivoting (No in step S170), the electromagnetic wave timepiece 1 returns to step S170, and checks the pivoting of the second hand 52 again.

On the other hand, if the second hand 52 is in the process of pivoting (Yes in step S170), the electromagnetic wave timepiece 1 determines whether the pivoting second hand 52 is stopped (step S172) and, if the second hand 52 is not stopped (No in step S172), it returns to step S172, and checks the stop of the second hand again.

On the other hand, if the second hand 52 is stopped, that is, in a case in which a second display is in a non-update condition (Yes in step S172), the electromagnetic wave timepiece 1 determines whether or not the hour hand 56, minute hand 54 and calendar 58 are stopped, that is, whether a minute, hour and date display are in a non-update condition (step S176). Herein, if the hour hand 56, minute hand 54 or calendar 58 are not in a stopped condition (No in step S176), the electromagnetic wave timepiece 1 returns to step S176, and checks their stop again.

Figure 3:
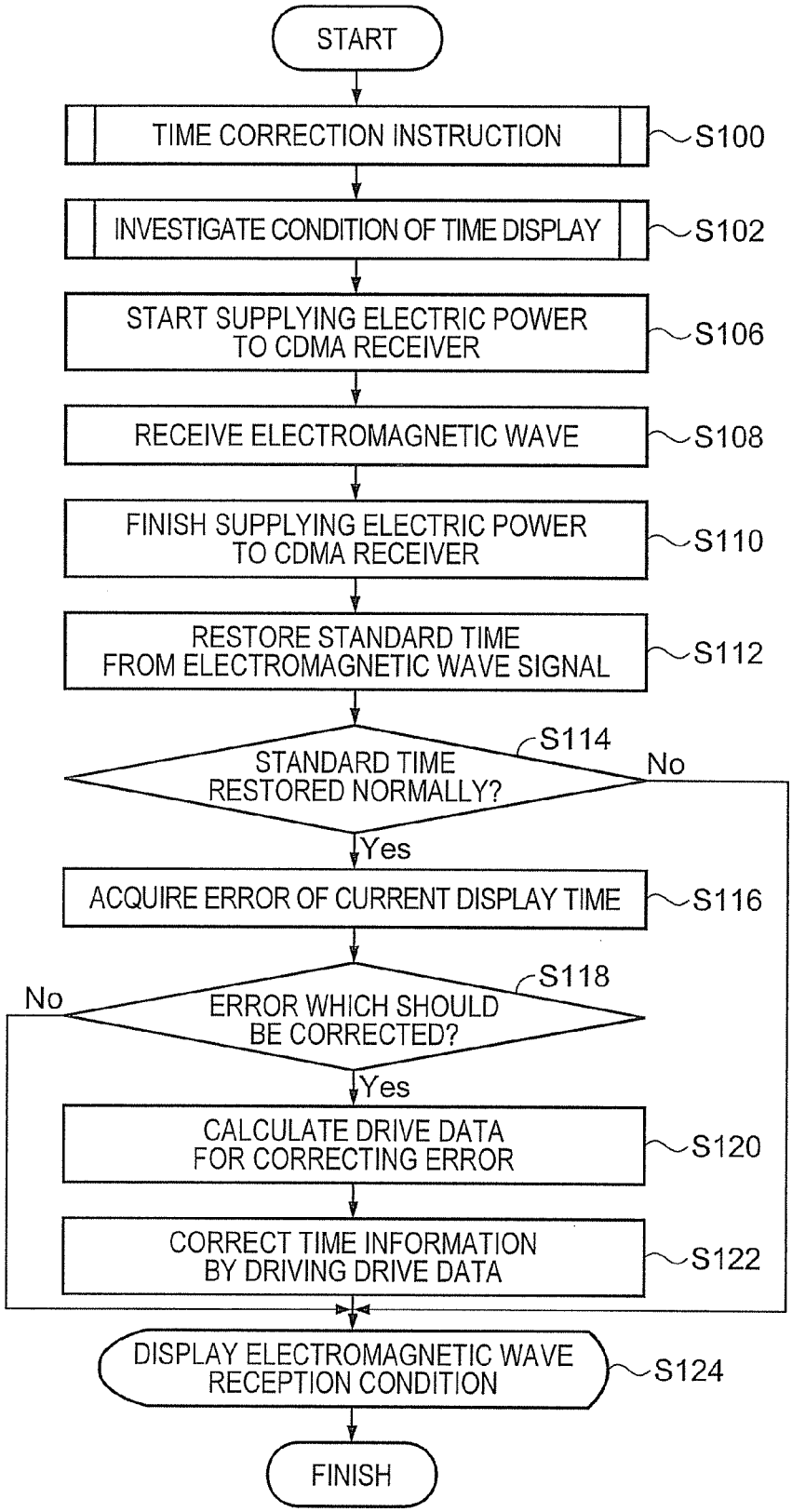
FIG. 3 is a flowchart showing a flow of a process in which a display time of the electromagnetic wave timepiece according to Embodiment 1 of the invention is corrected.
Figure 4:
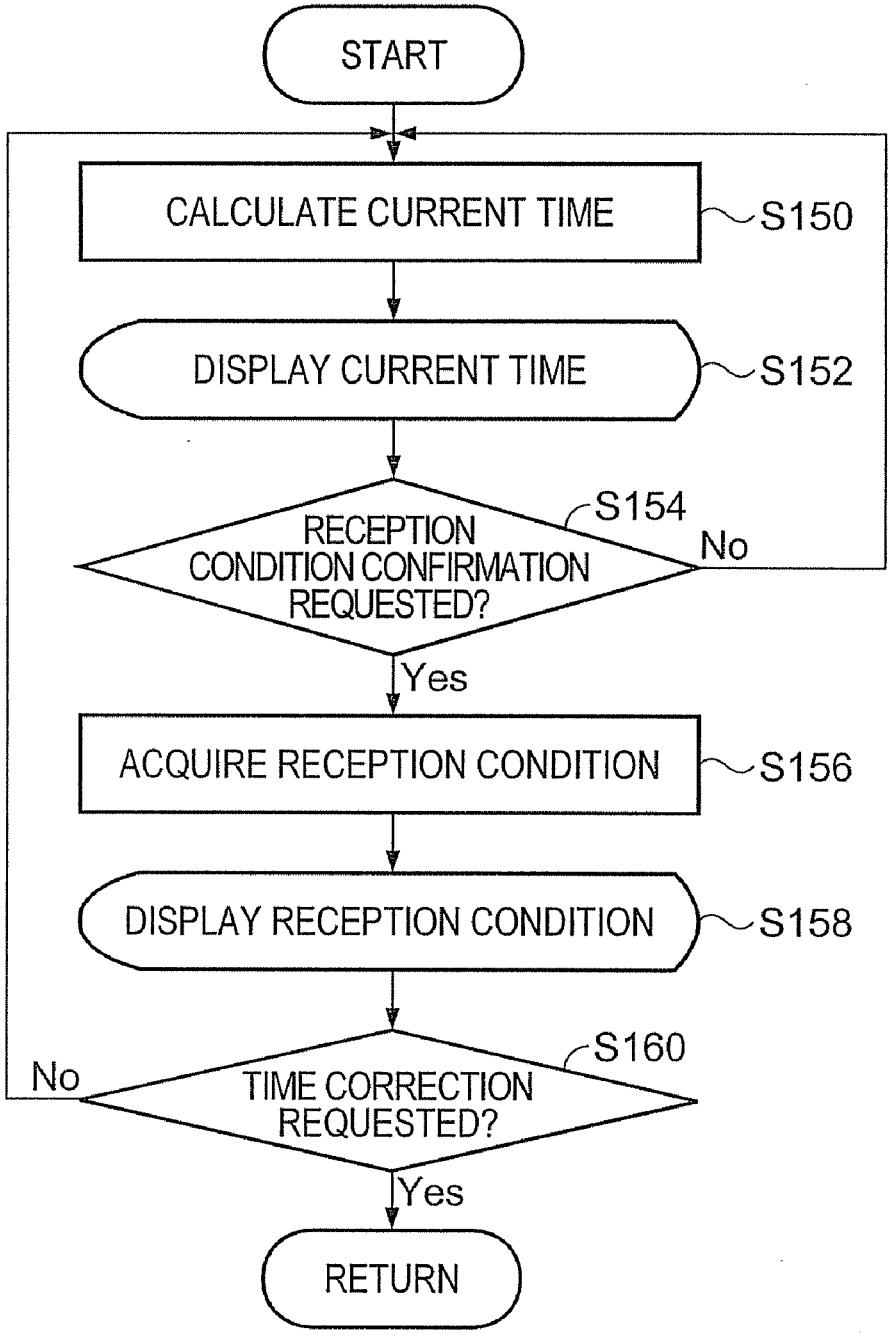
FIG. 4 is a flowchart showing a flow of a process in which an instruction is given from a user of the electromagnetic wave timepiece according to Embodiment 1 of the invention.

On the other hand, if the hour hand 56, minute hand 54 and calendar 58 are in the stopped condition (Yes in step S176), the electromagnetic wave timepiece 1 moves to a next process (step S106) of FIG. 3.

In step S106, the electromagnetic wave timepiece starts the supply of the electric power to the CDMA receiver 10. As a result of this, the CDMA receiver 10 is started up to make a transition to a condition in which it is ready to receive the electromagnetic wave signal. Continuing, the electromagnetic wave timepiece 1 instructs the CDMA receiver 10 to receive the electromagnetic wave signal, and the CDMA receiver 10, in accordance with this instruction, receives the electromagnetic wave signal over a certain time period (step S108). Continuing, the electromagnetic wave timepiece 1, after confirming the reception of the electromagnetic wave signal, finishes the supply of the electric power to the CDMA receiver 10 (step S110).

Next, the electromagnetic wave timepiece 1 restores the standard time serving as the reference from the received electromagnetic wave signal (step S112), and determines whether or not it has been able to restore the standard time normally (step S114). Herein, if the electromagnetic wave timepiece 1 has not been able to restore the standard time normally (No in step S114), it moves to step S124, displays the electromagnetic wave reception condition, and finishes the series of processes.

On the other hand, if the electromagnetic wave timepiece 1 has been able to restore the standard time normally (Yes in step S114), it acquires an error of the current display time with the standard time as the reference (step S116). Continuing, the electromagnetic wave timepiece 1 compares the error of the current display time and a reference value, and determines whether or not the error should be corrected (step S118). Herein, if the error is equal to or less than the reference value in accordance with which it should be corrected (No in step S118), the electromagnetic wave timepiece 1 moves to step S124, displays the electromagnetic wave reception condition, and finishes the series of processes.

On the other hand, if the error exceeds the reference value in accordance with which it should be corrected (Yes in step S118), the electromagnetic wave timepiece 1 calculates the drive data for driving the time display 22 in order to correct the error (step S120). Continuing, the electromagnetic wave timepiece 1 drives the drive data in the time display 22, corrects the time information being displayed on the time display 22 (step S122), displays the electromagnetic wave reception condition (step S124), and finishes the series of processes.

In the event that the user wants to correct a deviation of the display time of the electromagnetic wave timepiece 1, it is possible to match a time displayed in the electromagnetic wave timepiece 1 with the standard time included in the electromagnetic wave signal.

According to the heretofore described Embodiment 1, the following kinds of advantage are produced.

1. As the electromagnetic wave timepiece 1 is controlled in such a way that the electromagnetic wave reception operation and the time correction operation do not overlap each other, it is possible to avoid electric power consumed by the electromagnetic wave timepiece 1 rising abruptly. Particularly, in a small capacity battery such as a watch battery, a control of a maximum current contributes to a lengthening of a battery life.

2. In the electromagnetic wave timepiece 1, as no radio signal is received when the corrected time is displayed, it is possible to avoid the electromagnetic wave reception sensitivity decreasing due to the noise occurring when displaying the time.

3. As the electromagnetic wave timepiece 1 can acquire the accurate time information and correct the time while the second hand 52 is being intermittently driven, it is possible to always display the accurate time. Also, in the event that the electromagnetic wave timepiece 1 has not been able to receive the electromagnetic wave signal owing to an influence of an electromagnetic wave reception environment or the like, as it can receive the electromagnetic wave signal a plurality of times within approximately one second, it is possible to always display the accurate time regardless of an electromagnetic wave condition.

Embodiment 2

Figure 6:
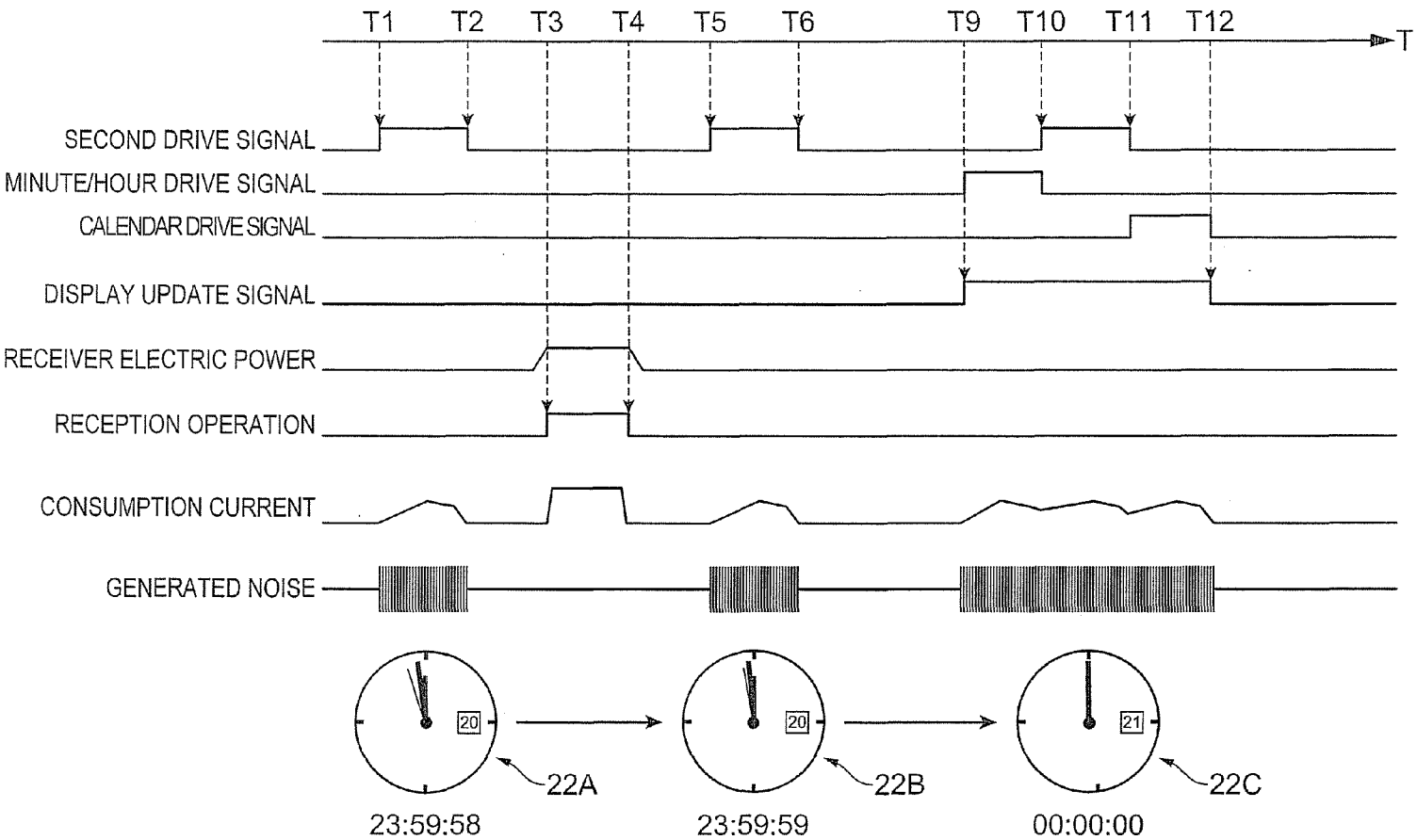
FIG. 6 is a diagram showing a process when a display of an electromagnetic wave timepiece according to Embodiment 2 of the invention makes a transition.
Figure 7:
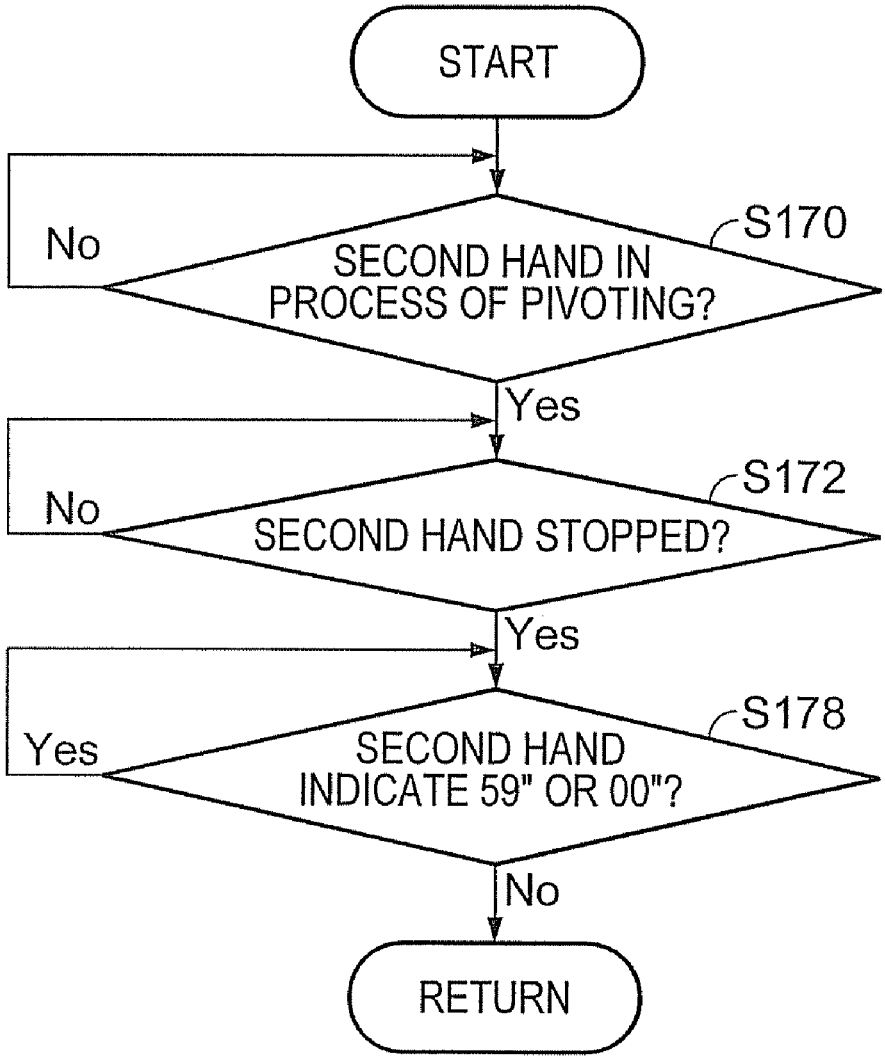
FIG. 7 is a flowchart showing a flow of a process which investigates a condition of a display time of the electromagnetic wave timepiece according to Embodiment 2 of the invention.

Next, a description will be given of Embodiment 2 of the invention, with reference to FIGS. 6 and 7. In the following description, the same portions as those already described are indicated by the same reference numerals, and a description thereof will be omitted. In Embodiment 1, in the event that the drive of the second hand 52 or the minute/hour display and calendar display rounding up operation has been detected, the electromagnetic wave timepiece 1 reserves the instruction to acquire the time data for the CDMA receiver 10, and waits for a completion of the rounding up operation to instruct the CDMA receiver 10 to acquire the time data. However, in Embodiment 2, as shown in FIG. 6, the electromagnetic wave timepiece 1 detects that the display time has reached a time to execute the rounding up operation. In Embodiment 2, the electromagnetic wave timepiece 1 detects a time at which the minute/hour drive unit 26 is driven, that is, a condition in which the second hand 52 stands between 59" and 00" and, in the event that this condition has been detected, that is, in the event of a time period from the time T6 to the time T12, the electromagnetic wave timepiece 1 does not instruct the CDMA receiver 10 to acquire the time data, regardless of an existence or otherwise of the detection of the rounding up operation.

Herein, a description will be given, based on FIG. 7, of a flow of a process (step S102, FIG. 3) which investigates the condition of the time display. Firstly, the electromagnetic wave timepiece 1 determines whether or not the second hand 52 is in the process of pivoting (step S170) and, if the second hand 52 is not in the process of pivoting (No in step S170), returns to step S170, and checks the pivoting of the second hand 52 again.

On the other hand, if the second hand 52 is in the process of pivoting (Yes in step S170), the electromagnetic wave timepiece 1 determines whether the second hand 52 is stopped (step S172) and, if the second hand 52 is not stopped (No in step S172), returns to step S172, and checks the stop of the second hand again.

On the other hand, if the second hand 52 is stopped, that is, if the second display is in the non-update condition (Yes in step S172), the electromagnetic wave timepiece 1 determines whether or not the second hand indicates 59" or 00" (step S178). Herein, if the second hand 52 indicates 59" or 00" (Yes in step S178), the electromagnetic wave timepiece 1 returns to step S178, and checks a position indicated by the second hand 52 again.

On the other hand, if the second hand 52 does not indicate either 59" or 00" (No in step S178), the electromagnetic wave timepiece 1 returns to the next process (step S106, FIG. 3).

According to the heretofore described Embodiment 2, in addition to the advantages in 1, 2 and 3 described in Embodiment 1, the following kind of advantage is produced.

4. As the electromagnetic wave timepiece 1 detects that the second hand 52 indicates 59" and 00" and, in the event that it has detected these, stops the reception operation, the process being easy in comparison with a case of detecting the display time rounding up operation, it is possible to reduce a power consumption.

Embodiment 3

Figure 8:
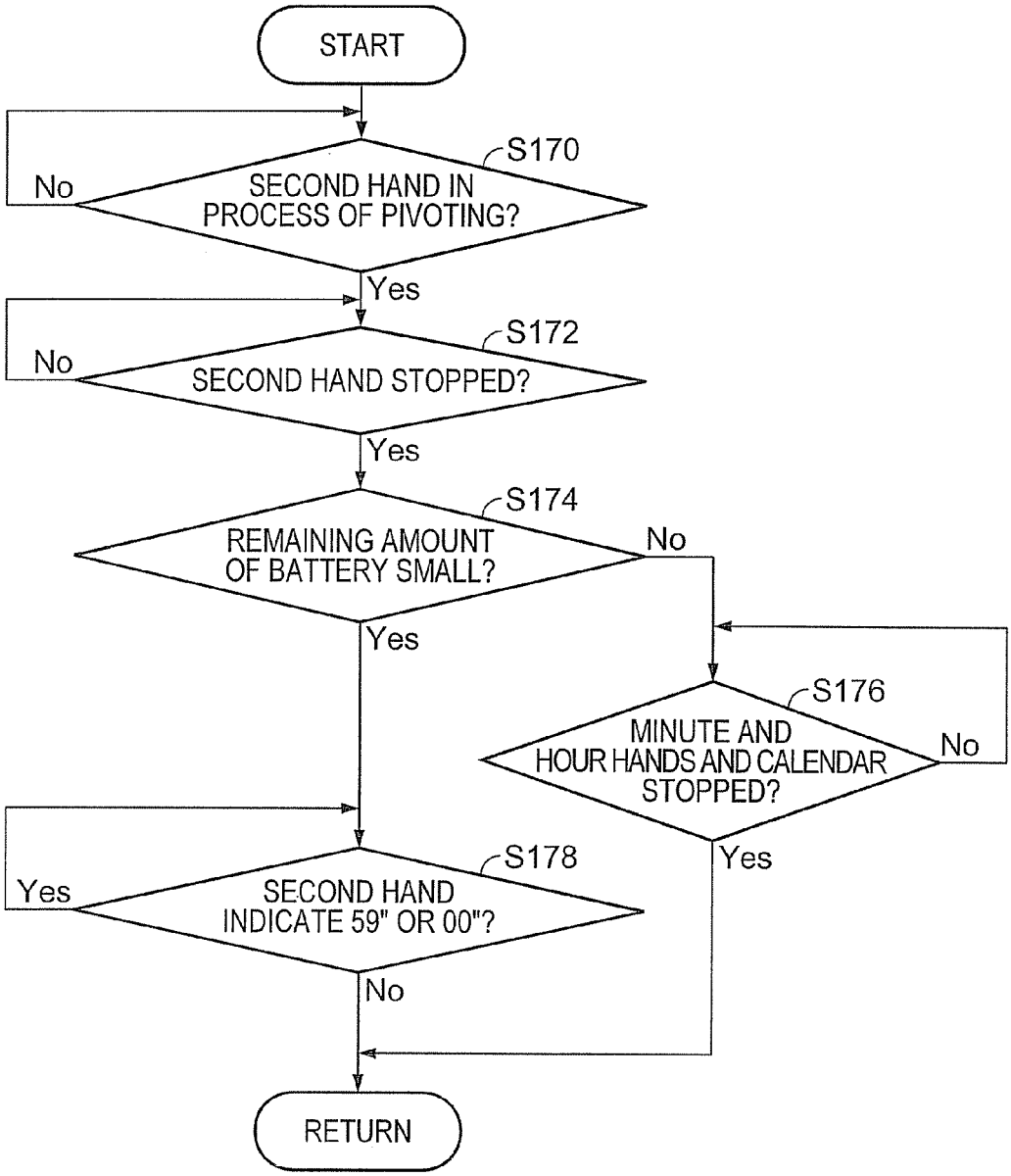
FIG. 8 is a flowchart showing a flow of a process which investigates a condition of a display time of an electromagnetic wave timepiece according to Embodiment 3 of the invention.

Next, a description will be given of Embodiment 3 of the invention, with reference to FIG. 8. In Embodiment 3, the power supply 18, as well as being assumed to be a battery, includes a remaining amount detection unit (not shown) which detects a remaining amount of consumable electric energy, and changes the evaluation of the minute/hour hand and calendar display rounding up operation in accordance with the detected remaining amount of energy.

Herein, a description will be given, based on FIG. 8, of a flow of a process (step S102, FIG. 3) which investigates the condition of the time display, in Embodiment 3. Firstly, the electromagnetic wave timepiece 1 determines whether or not the second hand 52 is in the process of pivoting (step S170) and, if the second hand 52 is not in the process of pivoting (No in step S170), returns to step S170, and checks the pivoting of the second hand 52 again.

On the other hand, if the second hand 52 is in the process of pivoting (Yes in step S170), the electromagnetic wave timepiece 1 determines whether the pivoting second hand 52 is stopped (step S172) and, if the second hand 52 is not stopped (No in step S172), returns to step S172, and checks the stop of the second hand again.

On the other hand, if the second hand 52 is stopped, that is, if the second display is in the non-update condition (Yes in step S172), the electromagnetic wave timepiece 1 detects a remaining amount of a battery capacity (step S174). Herein, if it is determined that the remaining amount of the battery capacity is smaller than a predetermined reference value (Yes in step S174), the electromagnetic wave timepiece 1 determines whether or not the second hand 52 indicates 59" or 00" (step S178). Herein, if the second hand 52 indicates 59" or 00" (Yes in step S178), the electromagnetic wave timepiece 1 returns to step S178, and checks a position indicated by the second hand 52 again. On the other hand, if the second hand 52 does not indicate either 59" or 00" (No in step S178), the electromagnetic wave timepiece 1 returns to the next process (step S106, FIG. 3).

Also, if it is determined that the remaining amount of the battery capacity is greater than the reference value (No in step S174), the electromagnetic wave timepiece 1 determines whether or not the hour hand 56, minute hand 54 and calendar 58 are in a stopped condition, that is, whether the minute, hour and date display are in a non-update condition (step S176). Herein, if the hour hand 56, minute hand 54 and calendar 58 are not in the stopped condition (No in step S176), the electromagnetic wave timepiece 1 returns to step S176, and checks the stop of them again.

On the other hand, if the hour hand 56, minute hand 54 and calendar 58 are in the stopped condition (Yes in step S176), the electromagnetic wave timepiece 1 returns to the next process (step S106, FIG. 3).

According to the heretofore described Embodiment 3, in addition to the advantages in 1, 2 and 3 described in Embodiment 1, the following kind of advantage is produced.

5. As the electromagnetic wave timepiece 1 can select a reception operation quantity in accordance with the remaining amount of the battery capacity, by increasing the reception operation quantity in the event that the battery capacity is large, it is possible to display a more accurate time while, by decreasing the reception operation quantity in the event that the battery capacity is small, it is possible to reduce a consumption current, and drive the electromagnetic wave timepiece for as long as possible.

Although the invention has heretofore been described based on the illustrated embodiments, the invention not being limited to the embodiments, it is also possible to assume kinds of modification example to be described hereafter.

1. The electromagnetic wave timepiece 1 not being limited to the analog watch, it is also acceptable that it is a digital watch. In this case, it is also acceptable that the second drive unit 24, minute/hour drive unit 26 and calendar drive unit 28 are, for example, drives which supply display signals to a liquid crystal panel. Also, although the controller 30 sends the time data acquisition instruction to the CDMA receiver 10 every second, without being limited to this, it is also acceptable that the instruction to acquire the time data is given to correct the time, in accordance with a predetermined time or time period of one day.

2. The electronic device of some aspects of the invention not being limited to the mode of the electromagnetic wave timepiece 1, it is also acceptable to apply it to an information processing terminal or the like in which is incorporated a timing function which corrects a time by means of an electromagnetic wave. It can be applied to, for example, a picture recorder equipped with a timing function for a picture recording reservation, a pay-broadcasting transceiver equipped with a viewing time measurement function, an electronic trading apparatus for securities such as stocks equipped with a trading implementation time determination function, a document creating apparatus equipped with a document creation date and time determination function, and the like.

What is claimed is:

1. An electronic device comprising:

an oscillator that generates a pulse signal;

a timer that measures a time using the pulse signal;

a display that displays information based on the time;

a receiver that acquires time information indicating a standard time; and a controller that instructs the receiver to acquire the time information, corrects the measured time, and instructs the display to update the information based on the corrected time, wherein the controller instructs so that acquiring the time information eliminates temporal overlap with updating the information based on the corrected time.

2. The electronic device according to claim 1, wherein the controller includes:

a reception instruction unit which instructs the receiver to acquire the time information;

an extraction unit which extracts the standard time from the acquired time information;

a correction unit which corrects a time deviation calculated based on the standard time; and a display control unit which instructs the display to display the information based on the corrected time, wherein the reception instruction unit, in a case in which the information based on the corrected time is displayed on the display, does not give the instruction to acquire the time information.

3. The electronic device according to claim 2, further comprising:

a detector which detects an update of the information based on the time displayed on the display, wherein the reception instruction unit, based on the detection of the detector, gives the instruction to acquire the time information.

4. The electronic device according to claim 3, wherein the update of the information includes an update made by means of a rounding up of the time.

5. The electronic device according to claim 3, wherein the detector further detects a finish of the update, and the reception instruction unit, in the event that the detector detects the finish of the update, gives the instruction to acquire the time information.

6. The electronic device according to claim 3, wherein the detector still further detects a predetermined display time, and the reception instruction unit, in the event that the detector detects the predetermined display time, does not give the instruction to acquire the time information.

7. The electronic device according to claim 6, still further comprising:

a power supply which supplies electric power; and a remaining amount detection unit which detects a remaining amount of the electric power which can be supplied from the power supply, wherein the reception instruction unit, in accordance with the detected remaining amount of the electric power, detects one of the update of the display time and the predetermined display time.

8. The electronic device according to claim 1, wherein the display's operation of displaying the information based on the corrected time is intermittently driven for a predetermined unit time period, and a time period required for the receiver's operation of acquiring the time information is shorter than the predetermined unit time period.

9. The electronic device according to claim 8, wherein the receiver's operation of acquiring the time information is executed for the time period for which the display's operation of displaying the information based on the corrected time is intermittently driven.

10. The electronic device according to claim 1, wherein the predetermined communication system is a code division multiple access system.

11. The electronic device according to claim 1, wherein the electronic device is driven by means of a small battery.

12. An electromagnetic wave timepiece comprising:

the electronic device according to claim 1.

13. The electromagnetic wave timepiece according to claim 12, wherein the electromagnetic wave timepiece is a wrist watch.

14. An electronic device comprising:

an oscillator that generates a pulse signal;

a timer that measures a time using the pulse signal;

a display that displays information based on the time;

a receiver that acquires time information indicating a standard time; and a controller that instructs the receiver to acquire the time information, corrects the measured time, and instructs the display to update the information based on the corrected time, wherein the controller instructs the receiver so that a first period of acquiring the time information does not overlap with a second period of updating the information based on the corrected time.

* * * * *